US010612751B2

(12) United States Patent
Shaikevitch et al.

(10) Patent No.: US 10,612,751 B2
(45) Date of Patent: Apr. 7, 2020

(54) ELECTRICAL SYSTEM WITH LIGHTING CONFIGURATION AND METHOD OF MANUFACTURE THEREOF

(71) Applicant: EoPlex, Limited, Hong Kong (CN)

(72) Inventors: Alex Shaikevitch, San Jose, CA (US); Sam Mahin Shirazi, San Jose, CA (US); Philip Eugene Rogren, Half Moon Bay, CA (US)

(73) Assignee: EOPLEX, LIMITED, Hong Kong (CN)

( * ) Notice: Subject to any disclaimer, the term of this patent is extended or adjusted under 35 U.S.C. 154(b) by 764 days.

(21) Appl. No.: 14/932,859

(22) Filed: Nov. 4, 2015

(65) Prior Publication Data

US 2016/0138781 A1 May 19, 2016

Related U.S. Application Data

(60) Provisional application No. 62/079,132, filed on Nov. 13, 2014.

(51) Int. Cl.

| | |
|---|---|
| ***F21V 7/04*** | (2006.01) |
| ***F21V 13/04*** | (2006.01) |
| ***F21V 7/00*** | (2006.01) |
| *F21V 5/04* | (2006.01) |
| *F21Y 115/10* | (2016.01) |

(52) U.S. Cl.

CPC ..... *F21V 13/04* (2013.01); *F21V 7/0025* (2013.01); *F21V 5/04* (2013.01); *F21Y 2115/10* (2016.08)

(58) Field of Classification Search

CPC ..... F21V 13/04; F21V 7/0025; F21V 5/04; F21Y 2115/10

USPC ..... 362/235

See application file for complete search history.

(56) References Cited

U.S. PATENT DOCUMENTS

| | | | | |
|---|---|---|---|---|
| 9,046,637 | B1 * | 6/2015 | Bennett | G02B 6/0096 |
| 2011/0254042 | A1 | 10/2011 | Shaikevitch | |

* cited by examiner

*Primary Examiner* — Elmito Breval

(74) *Attorney, Agent, or Firm* — Horizon IP PTE Ltd.

(57) ABSTRACT

An electrical system includes: a first base structure; a second base structure spaced apart from and opposing the first base structure; a lens unit including a first end portion attached to the first base structure and a second end portion attached to the second base structure; a first light source attached to the first base structure and enclosed within the lens unit; and a second light source attached to the second base structure and enclosed within the lens unit.

18 Claims, 6 Drawing Sheets

ELECTRICAL SYSTEM WITH LIGHTING CONFIGURATION AND METHOD OF MANUFACTURE THEREOF

CROSS-REFERENCE TO RELATED APPLICATION(S)

This application claims the benefit of U.S. Provisional Patent Application Ser. No. 62/079,132 filed Nov. 13, 2014, and the subject matters thereof are incorporated herein by reference thereto.

TECHNICAL FIELD

An embodiment of the present invention relates generally to an electrical system, and more particularly to an electrical system with a lighting configuration.

BACKGROUND

Modern consumer and industrial electronics, especially components such as light emitting diodes (LED), are providing increasing levels of functionality to support modern life. Research and development in the existing technologies can take a myriad of different directions.

The growth in functionality has resulted in new uses and applications. However, new uses and applications for the components compete for limited resources already distributed amongst many other existing systems or components therein.

Thus, a need still remains for an electrical system with improved lighting configuration that provides optimized light intensity and durability. In view of the ever-increasing commercial competitive pressures, along with growing consumer expectations and the diminishing opportunities for meaningful product differentiation in the marketplace, it is increasingly critical that answers be found to these problems.

Additionally, the need to reduce costs, improve efficiencies and performance, and meet competitive pressures adds an even greater urgency to the critical necessity for finding answers to these problems. Solutions to these problems have been long sought but prior developments have not taught or suggested any solutions and, thus, solutions to these problems have long eluded those skilled in the art.

SUMMARY

An embodiment of the present invention provides an electrical system, including: a first base structure; a second base structure spaced apart from and opposing the first base structure; a lens unit including a first end portion attached to the first base structure and a second end portion attached to the second base structure; a first light source attached to the first base structure and enclosed within the lens unit; and a second light source attached to the second base structure and enclosed within the lens unit.

An embodiment of the present invention provides an electrical system, including: a first base structure with a first reference surface; a second base structure spaced apart from the first base structure, the second base structure including a second reference surface facing the first reference surface; a lens unit including a first end portion attached to the first base structure and a second end portion attached to the second base structure, the lens unit further including phosphor, silicone, or a combination thereof; a light-emitting diode attached to the first reference surface of the first base structure and enclosed within the lens unit; and a second diode attached to the second reference surface of the second base structure and enclosed within the lens unit.

An embodiment of the present invention provides a method of manufacture of an electrical system including: providing base structures; attaching a lens unit to the base structures on a first end portion and a second end portion of the lens unit; and attaching light sources to the base structures.

Certain embodiments of the invention have other steps or elements in addition to or in place of those mentioned above. The steps or elements will become apparent to those skilled in the art from a reading of the following detailed description when taken with reference to the accompanying drawings.

DETAILED DESCRIPTION

Figure 1:
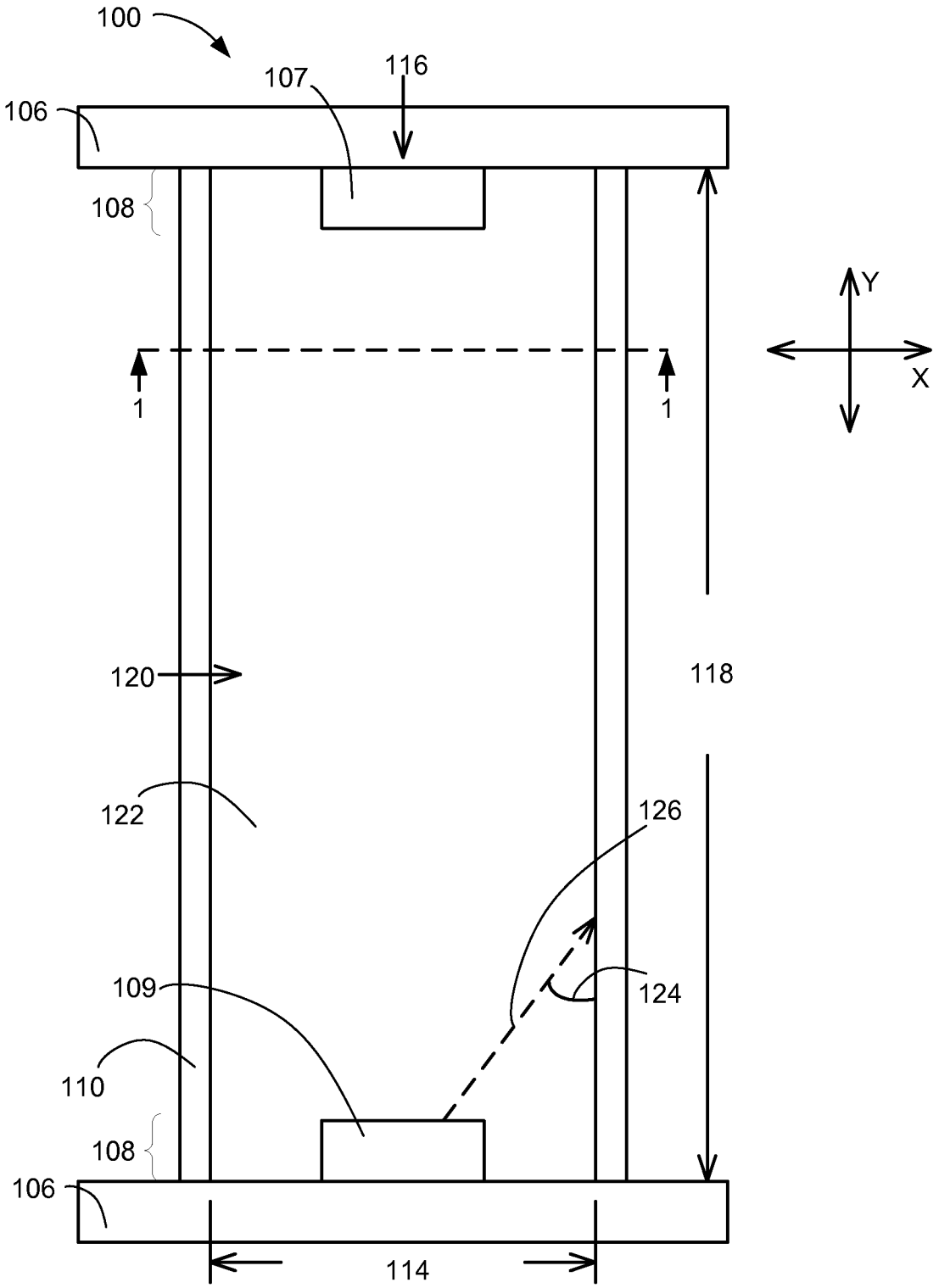
FIG. 1 is a vertical cross-sectional view of an electrical system with lighting configuration along a line 2-2 of FIG. 2 in an embodiment of the present invention.

An embodiment of the present invention includes an opposing set of base structures, each base structure including one or more light sources. The opposing set of base structures can be connected by a lens wall. The combination of the lens wall and the opposing base structures can include inner filler therein. The lighting sources can radiate light, which can react with the inner filler and the lens wall to further radiate light past the lens wall.

The following embodiments are described in sufficient detail to enable those skilled in the art to make and use the invention. It is to be understood that other embodiments would be evident based on the present disclosure, and that system, process, or mechanical changes may be made without departing from the scope of an embodiment of the present invention.

In the following description, numerous specific details are given to provide a thorough understanding of the invention. However, it will be apparent that the invention may be practiced without these specific details. In order to avoid obscuring an embodiment of the present invention, some well-known circuits, system configurations, and process steps are not disclosed in detail.

The drawings showing embodiments of the system are semi-diagrammatic, and not to scale and, particularly, some of the dimensions are for the clarity of presentation and are shown exaggerated in the drawing figures. Similarly, although the views in the drawings for ease of description generally show similar orientations, this depiction in the figures is arbitrary for the most part. Generally, the invention can be operated in any orientation. The embodiments have been numbered first embodiment, second embodiment, etc. as a matter of descriptive convenience and are not intended to have any other significance or provide limitations for an embodiment of the present invention.

Where multiple embodiments or manufacturing processes are disclosed and described, having some features in common, similar or like features in multiple drawing figures will ordinarily be described with similar reference numerals for clarity and ease of illustration, description, and comprehension thereof. For multiple embodiments, the embodiments have been sequenced, such as using first embodiment and second embodiment, as a matter of descriptive convenience and are not intended to have any other significance or provide limitations for the present invention.

For descriptive purposes, the term "horizontal" as used herein is defined as a plane parallel to the plane or surface of reference structure, such as a base structure or a substrate, regardless of its orientation. The term "vertical" refers to a direction perpendicular to the horizontal as just defined. Terms, such as "above", "below", "bottom", "top", "side", "higher", "lower", "upper", "over", and "under" are defined with respect to the horizontal plane, as shown in the figures. The term "on" means that there is direct contact among elements without having intervening materials. The term "processing" as used herein includes attaching or removing material, forming or shaping material, heating, cooling, cleaning, as required in manufacturing a described structure.

Figure 2:
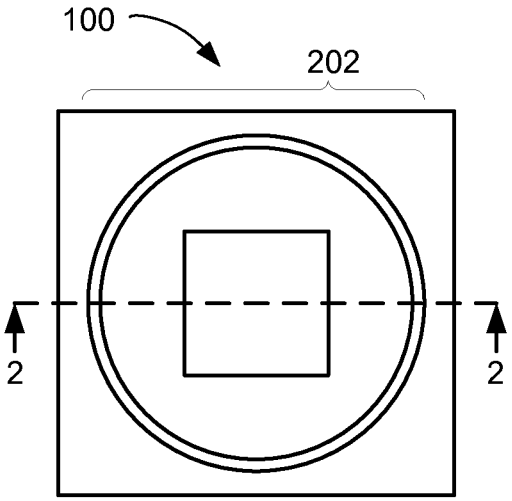
FIG. 2 is a horizontal cross-sectional view of the electrical system along a line 1-1 of FIG. 1.

Referring now to FIG. 1, therein is shown a vertical cross-sectional view of an electrical system 100 with lighting configuration along a line 2-2 of FIG. 2 in an embodiment of the present invention. The horizontal direction can be represented along the 'X-axis' and the vertical direction can be represented along the 'Y-axis' for FIG. 1.

The electrical system 100 can include a variety of devices or elements, such as a lamp, a visual signaling device, a lighting component within a larger system or device, or a combination thereof. The electrical system 100 can be included in a personal device, an enterprise system, a building or civil structures, or a combination thereof. The electrical system 100 can further include or couple with a controller, a management system, a power system, or a combination thereof.

The electrical system 100 can include a set of base structures 106. The base structures 106 can include objects, items, or portions within an object or item that provides attachment or reference for other structures. For example, the base structures 106 can include or correspond to a casing, a platform, a frame, portions therein, or a combination thereof.

As a more specific example, the base structures 106 can include substrates or wafers, such as thin slices of non-electrically-conductive or semi-conductive material. Also as a more specific example, the base structures 106 can include printed circuit boards (PCB), caps of a light bulb, a portion therein, or a combination thereof.

The base structures 106 can be opposing each other. For example, one of the base structures 106 can be above another separated by a gap. Also for example, the base structures 106 can overlap each other. Also for example, the base structures 106 can each be planar and oriented parallel to each other.

The electrical system 100 can include one or more instances of opposing light sources 108. The light sources 108 can include a first light source 107, a second light source 109, or a combination thereof. The first light source 107 and the second light source 109 can be vertically separated. The first light source 107 can be horizontally aligned relative to the second light source 109, mirrored or arranged in a complementary manner across a horizontal plane between the first light source 107 and the second light source 109, or a combination thereof.

The opposing group of the light sources 108 can each be a light emitting diode (LED). For example, the opposing light sources 108 can include one or more pairs of LEDs arranged or located on the base structures 106 to have physical association or relation to each other. As a more specific example, the opposing light sources 108 can include LED chips.

The opposing light sources 108 can each be attached to or integral with one instance of the base structures 106. For example, the opposing light sources 108 can be attached using a chemical adhesive, a mechanical or a structural connector, such as a brace or solder, or a combination thereof. Also for example, the opposing light sources 108 can be integral with the base structures 106 by sharing a structure or a component therein, such as by a chemical reaction, as a result of sintering or melting, or a combination thereof.

The base structures 106 can provide electrical power to the opposing light sources 108. The base structures 106 can further provide controls or regulators for the opposing light sources 108. The base structures 106 can include wires, traces, passive or active components, circuitry, or a combination thereof for providing the power, controlling or regulating, or a combination thereof for the opposing light sources 108.

The opposing light sources 108 can be separated vertically and aligned horizontally according to an arrangement or location on the base structures 106. The opposing light sources 108 can be located on the base structures 106 to have the opposing light sources 108 overlapping each other. Continuing with the example, for a paired set of LEDs, one of the LEDs can be attached to or integral with one substrate and the other LED can be attached to integral with the other substrate. The LEDs can be arranged or located such that they are facing or opposing each other, vertically separated, and horizontally aligned to overlap each other.

The electrical system 100 can further include a lens wall 110. The lens wall 110 is a structure allowing light to pass through. The lens wall 110 can further include the structure utilized in generating or emitting light. The lens wall 110 can further include a structure or a coating on an inner material. For example, the lens wall 110 can include silicone, phosphor, other similar material for illuminating or altering light, or a combination thereof formed in a cylindrical or a column shape. Also for example, the lens wall 110 can include silicone, phosphor, other similar material for illuminating or altering light, or a combination thereof applied as a coating to a solid filling structure.

The lens wall 110 can extend along a vertical direction between the base structures 106. The lens wall 110 can correspond to an outer perimeter surface in the horizontal direction. The lens wall 110 can further be attached to the base structures 106.

The lens wall 110 can correspond to a horizontal dimension 114 including a horizontal mid-region 116 and a vertical dimension 118 including a vertical mid-region 120. The horizontal dimension 114 can correspond to a width, a diameter, a portion thereof, or a combination thereof of the lens wall 110 or a shape thereof along the horizontal direction. The horizontal mid-region 116 can correspond to a mid-point or an area surrounding the mid-point for the horizontal dimension 114.

The vertical dimension 118 can include a length or a height of the lens wall 110 or a shape thereof along the vertical direction, with the vertical mid-region 120 corresponding to a mid-point or an area surrounding the mid-point for the vertical dimension 118. The base structures 106 can be spaced apart at a distance corresponding to or matching the vertical dimension 118 of the lens wall 110, the inner filler 122, or a combination thereof.

The lens wall 110 can further surround the light sources 108. For example, the light sources 108 can be located in relationship to the horizontal mid-region 116. As a more specific example, the light sources 108 can include one LED chip on each of the base structures 106 located or centered on the horizontal mid-region 116 of each of the base structures 106. Also as a more specific example, the light sources 108 can include a set of LED chips on each of the base structures 106 located and arranged equally about the horizontal mid-region 116.

The lens wall 110 and the base structures 106 can form an enclosed space. The electrical system 100 can include inner filler 122 within the enclosed space. The inner filler 122 is a light dispersing material for optimizing transmission of light from the light sources 108. The inner filler 122 can include viscous material or solid material. For example, the inner filler 122 can include silicone, phosphor, or a combination thereof.

The inner filler 122 can encapsulate the light sources 108. The inner filler 122 can contact the lens wall 110 and the base structures 106. The inner filler 122, the lens wall 110, or a combination thereof can provide a uniform medium for protecting the light sources 108, as well as for providing a light dispersing media for light generated by the light sources 108. The inner filler 122, the lens wall 110, or a combination thereof can further change or alter the light generated by the light sources 108, such as for wave lengths, colors, intensity, or a combination thereof.

For example, the light sources 108 can be embedded in the inner filler 122, such as silicone. The surface of the inner filler 122 can be then coated with the lens wall 110, such as silicone and phosphor.

Also for example, the light sources 108 can be coated with phosphor and silicone and then encapsulated in silicone for the inner filler 122. The lens wall 110 can be the outer edge or surface at the horizontal ends of the inner filler 122.

The inner filler 122, the lens wall 110, or a combination thereof can form an optical lens directing or redirecting light transmitted from the light sources 108. The inner filler 122, the lens wall 110, or a combination thereof can further transform the light transmitted from the light sources 108, such as by changing the wave length or the color.

The electrical system 100 can include the light sources 108, the lens wall 110, the inner filler 122, the horizontal dimension 114, the vertical dimension 118, or a combination thereof specifically configured according to light intensity perceived along the horizontal direction. The electrical system 100 can include the light sources 108, the lens wall 110, the inner filler 122, the horizontal dimension 114, the vertical dimension 118, or a combination thereof specifically configured to correspond to a target light intensity profile along the vertical dimension 118 with intensity levels corresponding to locations or points along the vertical dimension 118.

As a more specific example, the horizontal dimension 114 and the vertical dimension 118 can be controlled to provide a more uniform intensity level of lateral radiation along the vertical dimension 118. An aspect ratio corresponding to a ratio between the horizontal dimension 114 and the vertical dimension 118 can be directly related to degree of intensity near the vertical mid-region 120. The aspect ratio can be controlled to provide the uniform intensity.

It has been discovered that the light sources 108 including LEDs at opposite ends of and encapsulated by the inner filler 122 and the lens wall 110 provide optimized light output. The light output along the horizontal direction can drastically reduce as the perception point moves further away from an LED along the vertical direction. The opposing LEDs with the inner filler 122 and the lens wall 110 in between can provide greater total amount of light output and further provide a more uniform light intensity throughout the vertical direction of the electrical system 100 as perceived in lateral direction.

It has further been discovered that the aspect ratio and the light sources 108 can be used to provide more uniform light intensity across the vertical dimension 118. The aspect ratio can be controlled to create additive effect in light intensity from the two opposing LEDs. The additive effect can be controlled with the aspect ratio to provide uniform intensity level.

The light intensity as perceived in the lateral direction can be based on an incident angle 124. The incident angle 124 can be an angle measured between light traveling along a radiating direction 126 from one of the light sources 108 and the lens wall 110. Based on reflective and refractive characteristics of the inner filler 122, the lens wall 110, or a combination thereof, the light radiating through and out of the lens wall 110 from the light sources 108 can reduce as the incident angle 124 reduces. Further, light radiating through and out of the lens wall 110 can increase as the incident angle 124 increases, such as for a direct relationship between the incident angle 124 and the light intensity.

Referring now to FIG. 2, therein is shown a horizontal cross-sectional view of the electrical system 100 along a line 1-1 of FIG. 1. The electrical system 100 can include the lens wall 110 of FIG. 1, the inner filler 122 of FIG. 1, or a combination thereof corresponding to a cross-sectional shape of a circle or an ellipse, or an elliptical cross-section 202. The electrical system 100 can include the lens wall 110, the inner filler 122, or a combination thereof with a shape of a cylinder corresponding to circular or an elliptical cross-section along a horizontal plane.

The horizontal dimension 114 of FIG. 1 can correspond to a diameter or a length along an axis, such as a major or a minor axis. The line 2-2 for illustrating FIG. 1 can be coincident with the horizontal dimension 114.

The light sources 108 of FIG. 1 can be included within the cross-sectional shape of the lens wall 110, the inner filler 122, or a combination thereof. For illustrative purposes, the light sources 108 are shown having a shape or a cross section of a rectangular box. However, it is understood that the light sources 108 can correspond to many different shapes or cross-sections, such as circles, domes, any other polygon, cones or pyramids, equilateral or non-equilateral shapes, or a combination thereof.

Figure 3:
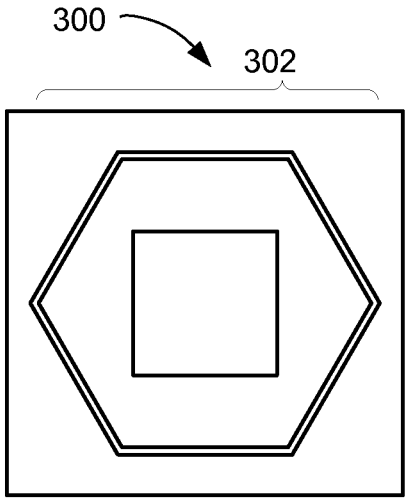
FIG. 3 is a further horizontal cross-sectional view along a line similar to the line 1-1 of FIG. 1 the electrical system in a further embodiment of the present invention.

Referring now to FIG. 3, therein is shown a further horizontal cross-sectional view of the electrical system 300 along a line similar to the line 1-1 of FIG. 1. In a further embodiment, the electrical system 300, similar to the electrical system 100 of FIG. 1, can correspond to a cross-sectional view different from FIG. 2.

The electrical system 300 can include the lens wall 110 of FIG. 1, the inner filler 122 of FIG. 1, or a combination thereof corresponding to a cross-sectional shape of a polygon. The electrical system 300 can include the lens wall 110, the inner filler 122, or a combination thereof with a shape of a column corresponding to a cross-section of a polygon, such as a triangle, a hexagon, or any other n-sided shape, along a horizontal plane. The electrical system 300 can include the lens wall 110, the inner filler 122, or a combination thereof corresponding to a polygonal cross-section 302.

The polygonal cross-section can correspond to an equilateral shape or a non-equilateral shape. The horizontal dimension 114 of FIG. 1 for the electrical system 300 can correspond to a length of one or more sides along the horizontal direction.

Figure 4:
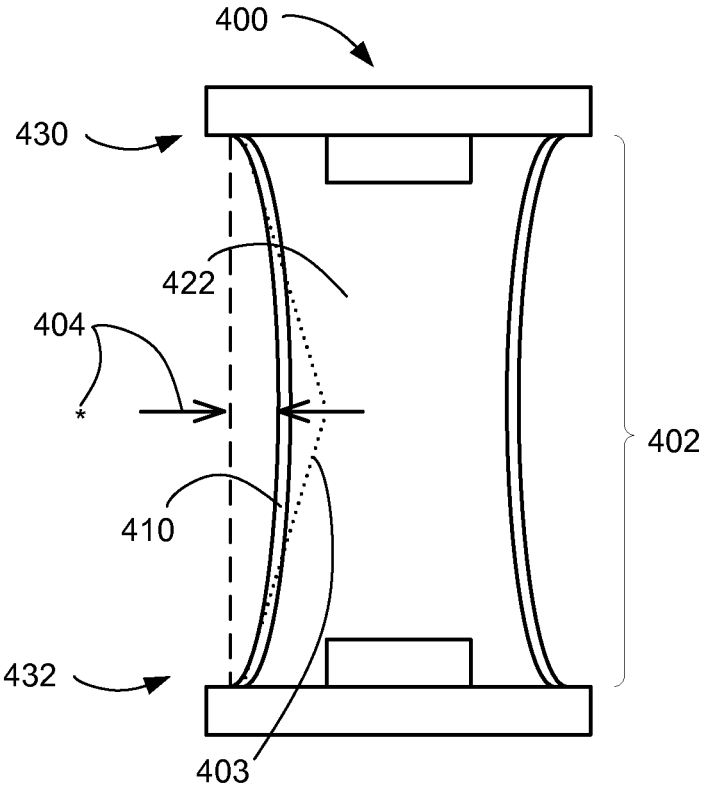
FIG. 4 is a vertical cross-sectional view a line similar to the line 2-2 of FIG. 2 of the electrical system in a further embodiment of the present invention.

Referring now to FIG. 4, therein is shown a vertical cross-sectional view of the electrical system 400 along a line similar to the line 2-2 of FIG. 2 in a further embodiment of the present invention. The electrical system 400 can be similar to the electrical system 100 of FIG. 1 but for a lens wall 410, an inner filler 422, or a combination thereof.

The lens wall 410 can be similar to the lens wall 110 of FIG. 1, such as in material, connection, dimensions, function, horizontal cross-sectional shape, processing or manufacturing thereof, or a combination thereof as described above. The inner filler 422 can be similar to the inner filler 122 of FIG. 1 such as in material, connection, dimensions, function, horizontal cross-sectional shape, processing or manufacturing thereof, or a combination thereof as described above.

The lens wall 410, the inner filler 422, or a combination thereof can have a different vertical cross-sectional shape than in FIG. 1. The lens wall 410, the inner filler 422, or a combination thereof can extend at an angle toward the horizontal mid-region 116 of FIG. 1 in extending from the base structures 106 of FIG. 1 to the vertical mid-region 120 of FIG. 1 according to a concave cross-section 402, an angled-linear cross-section 403, or a combination thereof. The lens wall 410, the inner filler 422, or a combination thereof can be narrower around the vertical mid-region 120 than at end portions, such as a first end portion 430, a second end portion 432, or a combination thereof for opposing ends, such as for a distal end, a proximal end, or a combination thereof.

The first end portion 430, the second end portion 432, or a combination thereof of the inner filler 422, the lens wall 410, or a combination thereof can correspond to the portions thereof attached to the base structures 106, including or encapsulating the light sources 108 of FIG. 1, or a combination thereof. The lens wall 410, the inner filler 422, or a combination thereof can include the vertical cross-sectional shape with a taper near the vertical mid-region 120. The inner filler 422, the lens wall 410, or a combination thereof can include the horizontal dimension 114 of FIG. 1 less than or narrower at or near the vertical mid-region 120 than at the first end portion 430, the second end portion 432, or a combination thereof for the concave cross-section 402, the angled-linear cross-section 403, or a combination thereof.

For illustrative example, the lens wall 410, the inner filler 422, or a combination thereof are shown having the vertical cross-sectional shape with a smooth curved shape corresponding to the concave cross-section 402. However, it is understood that the lens wall 410, the inner filler 422, or a combination thereof can have the vertical cross-sectional shape corresponding to many different shapes, such as a continuous surface with multiple connected planar sections corresponding to the angled-linear cross-section 403 and exemplified by dotted lines for two planar sections joining at an angle.

The vertical cross-sectional shape can be characterized or represented by a shape measure 402. The shape measure 402 can include a distance, a focal point, or a combination thereof. For example, the shape measure 404 can include a focal point or a center point, as illustrated by '*' in FIG. 4, for describing a shape or a rate of change in angle of orientation for a smooth curved surface corresponding to a parabolic or an arc-like cross-sectional shape. Also for example, the shape measure 404 can include a number of planar surfaces or a relative location and an angle between planar surfaces on the cross-sectional shape.

Also for example, the shape measure 404 can correspond to a distance along the horizontal direction between vertical lines matching outer most edge and inner most edge of the lens wall 410, the inner filler 422, or a combination thereof. As a more specific example, the shape measure 404 can correspond to a change in distance along the horizontal distance between a location where the lens wall 410, the inner filler 422, or a combination thereof contacts one of the base structures 106 and corresponding location at or on the vertical mid-region 120 as illustrated in FIG. 4.

It has been discovered that the concave cross-section 402 for the lens wall 410, the inner filler 422, or a combination thereof provides increased efficiency in generating the horizontal light intensity. The concave cross-section 402 can increase the incident angle 124 of FIG. 1 for light generated by the light sources 108 for locations on the lens wall 410 between the light sources 108 and vertical mid-region 120. The increase in the incident angle 124 can allow more light to transmit through the lens wall 410, the inner filler 422, or a combination thereof to provide the horizontal light intensity.

The electrical system 100 can include the lens wall 410, the inner filler 422, or a combination thereof with the concave cross-section 402 and the shape measure 404 configured to generate a target light intensity profile along the vertical dimension 118 of FIG. 1 with intensity levels corresponding to locations or points along the vertical dimension 118. The concave cross-section 402 and the shape measure 404 can be configured according to a color or a capacity of the light sources 108, the vertical dimension 118, the horizontal dimension 114, or a combination thereof.

Figure 5:
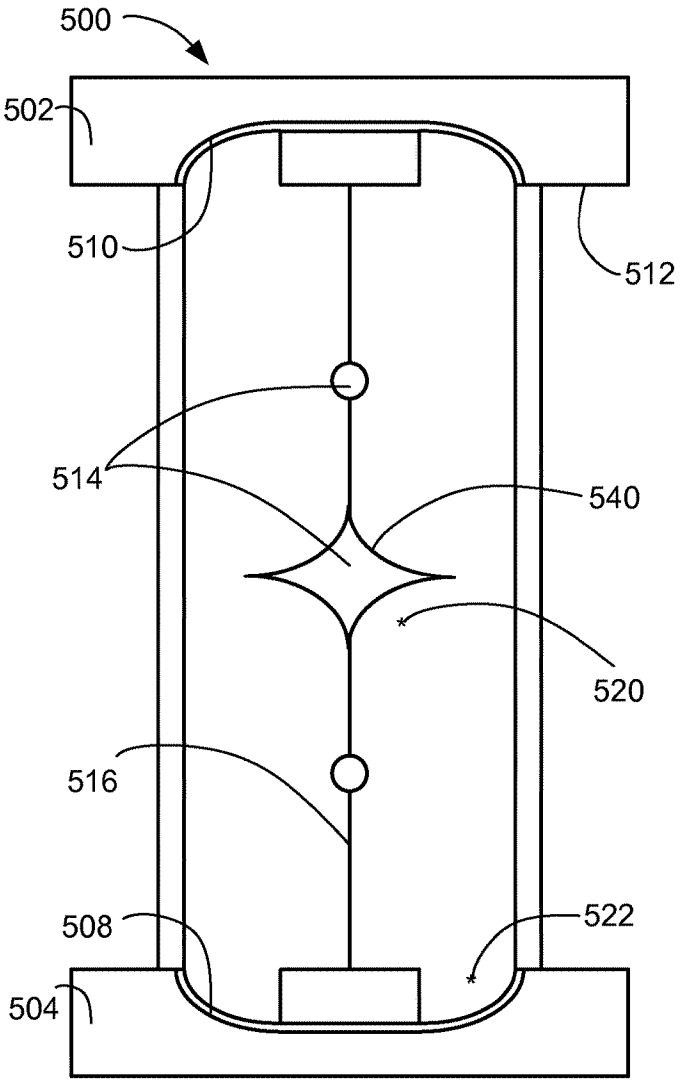
FIG. 5 is a vertical cross-sectional view a line similar to the line 2-2 of FIG. 2 of the electrical system in a further embodiment of the present invention.

Referring now to FIG. 5, therein is shown a vertical cross-sectional view of the electrical system 500 along a line similar to the line 2-2 of FIG. 2 in a further embodiment of the present invention. The electrical system 500 can be similar to the electrical system 100 of FIG. 1. For example, the electrical system 500 can include the light sources 108 of FIG. 1, the lens wall 110 of FIG. 1, the inner filler 122 of FIG. 1, or a combination thereof.

The electrical system 500 can include a first base structure 502, a second base structure 504, or a combination thereof corresponding to the base structures 106 of FIG. 1. The first base structure 502, the second base structure 504 can include instances of the base structures 106 including a base cavity 510 on a reference surface 512 therein.

The reference surface 512 can correspond to a surface on the base structures 106 facing or connected to the lens wall 110, the inner filler 122, or a combination thereof. The reference surface 512 can be planar, such as for substrates.

For example, the reference surface 512 can be a bottom surface on the first base structure 502 located at the top of the electrical system 500 with the reference surface 512 facing the second base structure 504. Also for example, the reference surface 512 can be a top surface on the second base structure 504 located at the bottom of the electrical system 500 with the reference surface 512 facing the first base structure 502.

The base cavity 510 is a depression in the base structures 106. Vertical dimension, such as for a thickness, of the base structures 106 can be less in the base cavity 510 than outside of the base cavity 510. The base cavity 510 can be located relative to the horizontal mid-region 116 of FIG. 1. For example, the base cavity 510 can overlap or be centered on the horizontal mid-region 116.

The electrical system 500 can include the light sources 108 of FIG. 1 located within the base cavity 510. For example, light sources 108 can be attached to or integral with the base cavity 510. Also for example, the light sources 108 can be centered at or located about the horizontal mid-region 116.

The electrical system 500 can further include a substrate reflector 508 in the base cavity 510. The substrate reflector 508 is a reflective surface or a structure including the reflective surface on one or more of the base structures 106. The substrate reflector 508 can include reflective surfaces on or throughout the base cavity 510. The substrate reflector 508 can further include reflective surfaces horizontally surrounding the light sources 108.

The substrate reflector 508 can include a mirror, a reflective paint or coating, or a combination thereof on the base structures 106. The substrate reflector 508 can be on the base structures 106. For example, the substrate reflector 508 can be attached to one or more of the base structures 106 in the base cavity 510. Also for example, the substrate reflector 508 can be integral with the base cavity 510, the reference surface 512, or a combination thereof.

The electrical system 500 can further include one or more instances of a suspended reflector 514. The suspended reflector 514 is a structure with one or more reflective surfaces located within the inner filler 122 between the base structures 106. The suspended reflector 514 can be configured to reflect light generated or emitted by the light sources 108. The suspended reflector 514 can correspond to a shape, a size, a location, a relative arrangement, or a combination thereof specifically configured to reflect light in generating the target light intensity profile.

For example, the suspended reflector 514 can include a ball, a bead, a box, or a combination thereof. Also for example, the suspended reflector 514 can include a structure corresponding to a diamond or a conical shape. Also for example, the suspended reflector 514 can include a planar surface, a curved surface, angles or joints between surfaces with different orientations, or a combination thereof with reflective properties, such as utilizing a reflective coating or a material with reflective surface.

Also for example, the suspended reflector 514 can be affixed at a particular location within the inner filler 122 using a reflector stabilizer 516. The reflector stabilizer 516 is a connector configured to affix the reflector stabilizer 516 at a specific location relative to the inner filler 122, the light sources 108, the base structures 106, the lens wall 110, or a combination thereof, including a wire, a string, a frame, a lever or an extension, or a combination thereof. The reflector stabilizer 516 can be attached to or integral with the suspended reflector 514 along with one or more of the light sources 108, one or more of the base structures 106, the inner filler 122, the lens wall 110, a portion therein, or a combination thereof.

Also for example, the suspended reflector 514 can be affixed at a particular location relative to the light sources 108 by the inner filler 122. The inner filler 122 can be solid or become solid during manufacturing or processing. The suspended reflector 514 can be placed within the inner filler 122 at a specific location during manufacturing or processing to be encased or encapsulated by the inner filler 122 and affixed at the specific location.

The electrical system 100 can include the substrate reflector 508, the suspended reflector 514, or a combination thereof specifically configured to generate the target light intensity profile. For example, the substrate reflector 508, the suspended reflector 514, or a combination thereof can include a specific cross-sectional shape as represented by the shape measure 404 of FIG. 4.

For illustrative example, the substrate reflector 508 and the suspended reflector 514 are both shown with smooth curved surfaces corresponding to a concave depression or a convex surface for a curved reflective surface 540. The shape measure 404 can include a suspended reflector measure 520 for the suspended reflector 514, a substrate reflector measure 522 for the substrate reflector 508, or a combination thereof. For the curved reflective surface 540, the suspended reflector measure 520, the substrate reflector measure 522, or a combination thereof can include a coordinate or a relative location representing a focal point or region for light reflected from the substrate reflector 508, the suspended reflector 514, or a combination thereof.

Also for example, the suspended reflector 514 can be located at the specific location relative to the light sources 108, the horizontal dimension 114 of FIG. 1, the vertical dimension 118 of FIG. 1, or a combination thereof. As a more specific example, the suspended reflector 514 can be located at the vertical mid-region 120 of FIG. 1, the horizontal mid-region 116, at a location off-set from one or more mid-regions or edges of the inner filler 122, or a combination thereof. Also as a more specific example, a set of multiple suspended reflectors 514 can be located and arranged around the vertical mid-region 120, the horizontal mid-region 116, or a combination thereof.

It has been discovered that the suspended reflector 514 provides increased efficiency in generating light intensity. The suspended reflector 514 can reflect light from the light sources 108 to increase the incident angle 124 of FIG. 1. The suspended reflector 514 can reflect light radiating in certain directions to increase the incident angle 124, which can allow the reflected light to radiate through and past the lens wall 110. The increase in instances of the radiating direction 126 of FIG. 1 with sufficient instance of the incident angle 124 using the suspended reflector 514 can create brighter light intensity.

It has also been discovered that the suspended reflector 514 and the substrate reflector 508 together provide even more increased efficiency and uniform light intensity. The locations and shapes of the suspended reflector 514 and the substrate reflector 508 along with the aspect ratio can be configured to increase the radiating directions 126 with sufficient incident angle 124. Moreover, the locations and shapes of the suspended reflector 514 and the substrate reflector 508 can be used to control amount of light radiating through specific locations along the vertical dimension 118 to create the uniform intensity.

The suspended reflector 514, the substrate reflector 508, the aspect ratio, configurations thereof, or a combination thereof can be controlled during processing or manufacturing. For example, the electrical system 500 or a portion therein can be processed or manufactured with a 3-dimensional printer, which can control shape and locations in 3-dimensional space with precision control.

Figure 6:
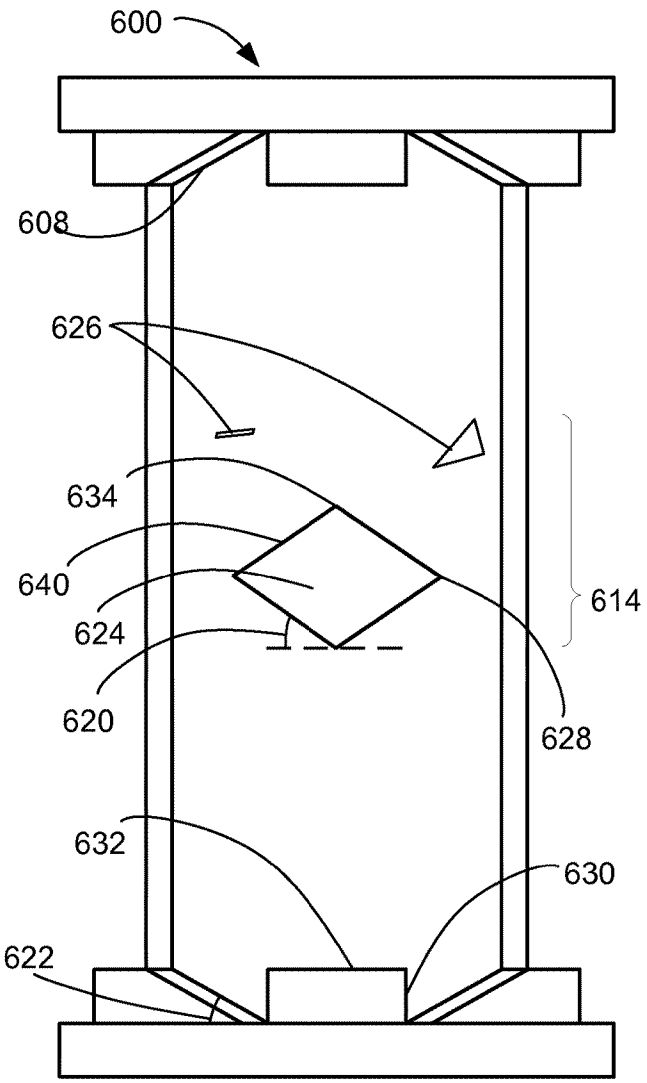
FIG. 6 is a vertical cross-sectional view a line similar to the line 2-2 of FIG. 2 of the electrical system in a further embodiment of the present invention.

Referring now to FIG. 6, therein is shown a vertical cross-sectional view of the electrical system 600 along a line similar to the line 2-2 of FIG. 2 in a further embodiment of the present invention. The electrical system 500 can be similar to the electrical system 100 of FIG. 1, the electrical system 500 of FIG. 5, or a combination thereof. For example, the electrical system 600 can include the light sources 108 of FIG. 1, the lens wall 110 of FIG. 1, the inner filler 122 of FIG. 1, or a combination thereof.

Also for example, the electrical system 600 can include a substrate reflector 608, a suspended reflector 614, or a combination thereof. The substrate reflector 608 can be similar to the substrate reflector 508 of FIG. 5. The suspended reflector 614 can be similar to the suspended reflector 514 of FIG. 5.

The substrate reflector 608, the suspended reflector 614, or a combination thereof can illustrate shapes different from FIG. 5. The suspended reflector 614 can correspond to a suspended reflector measure 620 different from the suspended reflector measure 520 of FIG. 5, the substrate reflector 608 can correspond to a substrate reflector measure 622 different from the substrate reflector measure 522 of FIG. 5, or a combination thereof.

For illustrative example, the substrate reflector 608, the suspended reflector 614, or a combination thereof can correspond to planar cross sectional shapes for a linear reflective surface 640. For example, the suspended reflector measure 620, the substrate reflector measure 622, or a combination thereof for the linear reflective surface 640 can correspond to one or more angles. The substrate reflector measure 622 can correspond to an angle between the linear reflective surface 640 or a portion thereof for the substrate reflector 608 and a horizontal plane or the reference surface 512 of FIG. 5. The suspended reflector measure 620 can correspond to an angle between the linear reflective surface 640 or a portion thereof for the suspended reflector 614 and the horizontal plane or the reference surface 512.

The electrical system 500 as illustrated in FIG. 5, the electrical system 600 as illustrated in FIG. 6, or a combination thereof can include various different types of the suspended reflector 514, the suspended reflector 614, or a combination thereof. For example, the suspended reflector 514, the suspended reflector 614, or a combination thereof can include a central reflector 624, an offset reflector 626, or a combination thereof.

The central reflector 624 is the suspended reflector located in or at the horizontal dimension 114 of FIG. 1, the vertical dimension 118 of FIG. 1, or a combination thereof. The central reflector 624 can be located within the inner filler 122, the lens wall 110, or a combination thereof along or on a plane parallel and coincident with the horizontal direction, the vertical direction, or a combination thereof at or on the horizontal mid-region 116 of FIG. 1, the vertical mid-region 120 of FIG. 1, or a combination thereof.

The central reflector 624 can have a shape or a size configured to generate a target intensity profile. For example, the central reflector 624 can have the shape corresponding to the suspended reflector measure 520 or 620 as illustrated in FIG. 5 and FIG. 6.

Also for example, the central reflector 624 can extend in the horizontal direction with a reflector horizontal edge 628 between the horizontal mid-region 116 and a source horizontal edge 630, up to or aligned with the source horizontal edge 630, extend to between the source horizontal edge 630 and the lens wall 110, or extend up to or abutting the lens wall 110. Also for example, the central reflector 624 can extend in the vertical direction with a reflector vertical edge 632 between the vertical mid-region 120 and a source vertical edge 634, or extend up to or abutting one or more of the light sources 108.

The offset reflector 626 is the suspended reflector located at a location outside of or not aligned with the horizontal mid-region 116 and the vertical mid-region 120. The offset reflector 626 can be located between the horizontal mid-region 116 and the lens wall 110, between the vertical dimension 118 and one or more of the light sources 108, or a combination thereof. The electrical system 600 can include a set of multiple instances of the offset reflector 626 arranged around a horizontal line or plane, a vertical line or plane, or a combination thereof coincident with the vertical mid-region 120, the horizontal mid-region 116, or a combination thereof.

The offset reflector 626 can include various shapes, such as curved surfaces, planar surfaces, or a combination thereof. For example, the offset reflector 626 can include beads, flecks, cones, diamond structures, conical structures, or a combination thereof.

Figure 7:
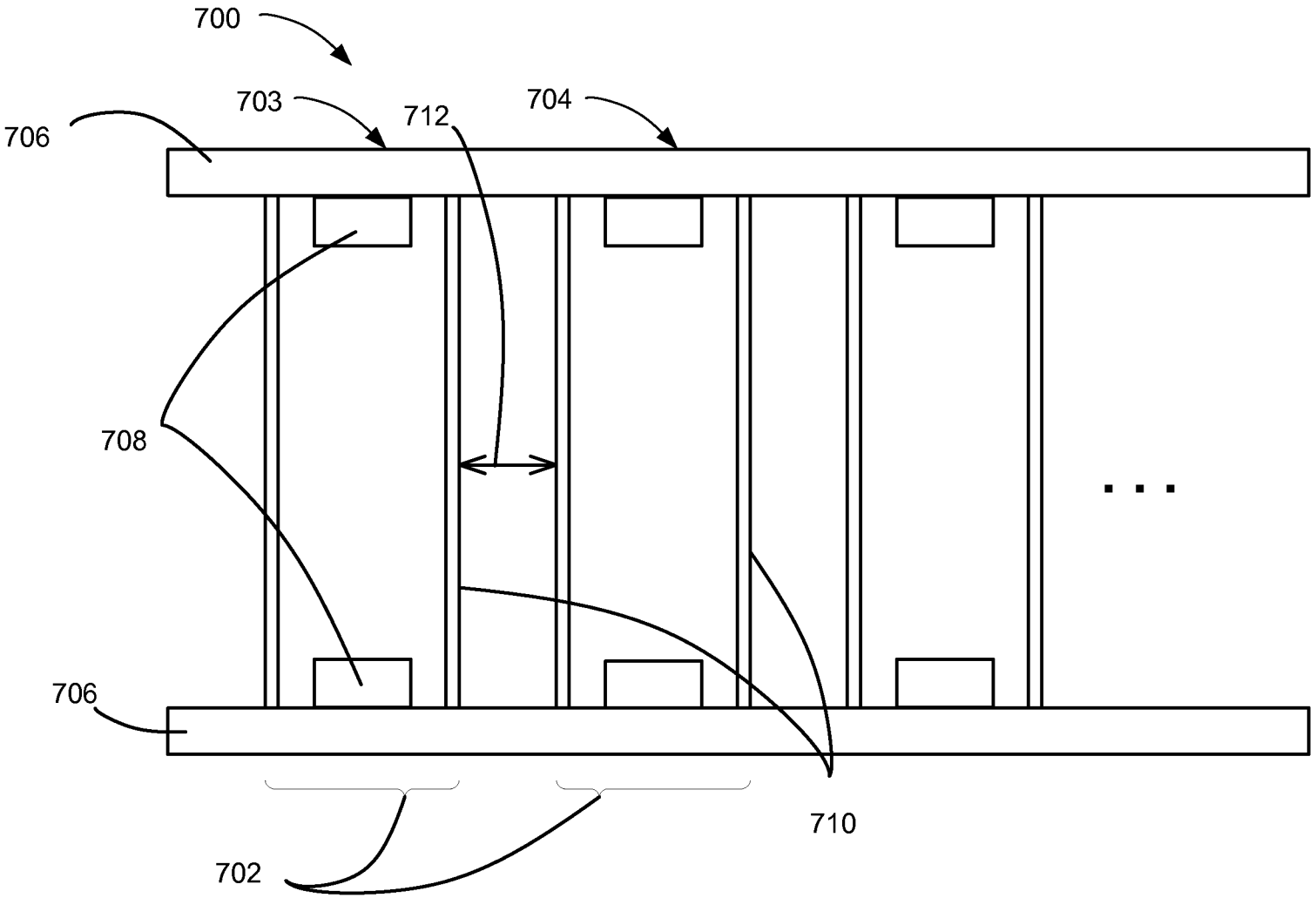
FIG. 7 is a vertical cross-sectional view a line similar to the line 2-2 of FIG. 2 of the electrical system in a further embodiment of the present invention.

Referring now to FIG. 7, therein is shown a vertical cross-sectional view of the electrical system 700 along a line similar to the line 2-2 of FIG. 2 in a further embodiment of the present invention. The electrical system 700 can be similar to the electrical system 100 of FIG. 1. For example, the electrical system 700 can include the light sources 108 of FIG. 1, the lens wall 110 of FIG. 1, the inner filler 122 of FIG. 1, the base structures 106 of FIG. 1, or a combination thereof.

The electrical system 700 can include multiple lighting units 702 for a set of base structures 706. The electrical system 700 can include several lamps or separate instances of the lighting units 702 connected to or sharing a same set of the base structures 706.

For example, the electrical system 700 can include a pairing of opposing substrates, one on proximal end and the other on distal end of the electrical system 700 for the set of base structures 706. The electrical system 700 can include the set of base structures 706 attached to the lighting units 702, each including a set of the light sources 108, the lens wall 110, the inner filler 122, or a combination thereof.

As a more specific example, the electrical system 700 can include a first lighting set 703, a second lighting set 704, or more. The first lighting set 703 and the second lighting set 704 can each be an instance of the lighting units 702, such as the embodiment exemplified by the lighting system 100 of FIG. 1, the lighting system 300 of FIG. 3, the lighting system 400 of FIG. 4, the lighting system 500 of FIG. 5, the lighting system 600 of FIG. 6, or a combination thereof sharing the same set of base structures 706.

Each of the lighting units 702 can include a source set 708. The source set 708 can include a set of the light sources 108 located and arranged on both of the base structures 706. The source set 708 can include one or more instances of the light sources 108 attached to or integral with one instance of the base structures 706 along with one or more instances of the light sources 108 attached to or integral with the other opposing instance of the base structures 706.

Each source set 708 can be surrounded by a lens unit 710. The lens unit 710 can include the lens wall 110 and the inner filler 122. The lens unit 710 can include the lens wall 110 horizontally surrounding the source set 708, the inner filler 122 encapsulating the source set 708, or a combination thereof for each of the corresponding lighting units 702.

The first lighting set 703 can include an instance of the source set 708 and an instance of the lens unit 710. The second lighting set 704 can include a different instance of the source set 708 and a different instance of the lens unit 710. Any further sets, such as third or fourth lightings sets, sharing the same set of base structures 706 can further each include a corresponding instance of the source set 708 and the lens unit 710.

The electrical system 700 can include the lighting units 702 located on the set of base structures 706 according to a lighting arrangement 712. The lighting arrangement 712 can include locations of the lighting units 702 relative to the set of base structures 706, relative to each other, or a combination thereof.

For example, the lighting arrangement 712 can include a set of coordinates on the set of base structures 706 corresponding to each of the lighting units 702, one or more of the components therein, or a combination thereof. Also for example, the lighting arrangement 712 can include a distance or a gap between the lens units 710 of adjacent lighting units 702.

For illustrative purposes, the electrical system 700 has been shown with the lighting units 702 corresponding to same size, including a pair of the source set 708, and equidistance apart for the lighting arrangement 712. However, it is understood that the electrical system 700 can be different. For example, the vertical dimension 118 of FIG. 1, the horizontal dimension 114 of FIG. 1, or a combination thereof can be different across the lighting units 702.

Also for example, the lighting arrangement 712 can include points along a two-dimensional shape on the set of base structures 706 as discussed above. Also for example the set of base structures 706 can be arranged or oriented non-parallel to each other, with the lighting units 702 shaped and sized according to the orientation of the set of base structures 706.

The electrical system 700 can include a configuration including the arrangement of the base structures 706, a quantity of the lighting units 702, the size or shape thereof, including the horizontal dimension 114 or the vertical dimension 118, the lighting arrangement 712, reflectors, or a combination thereof. The lighting configuration can be designed to provide a target light intensity profile.

Figure 8:
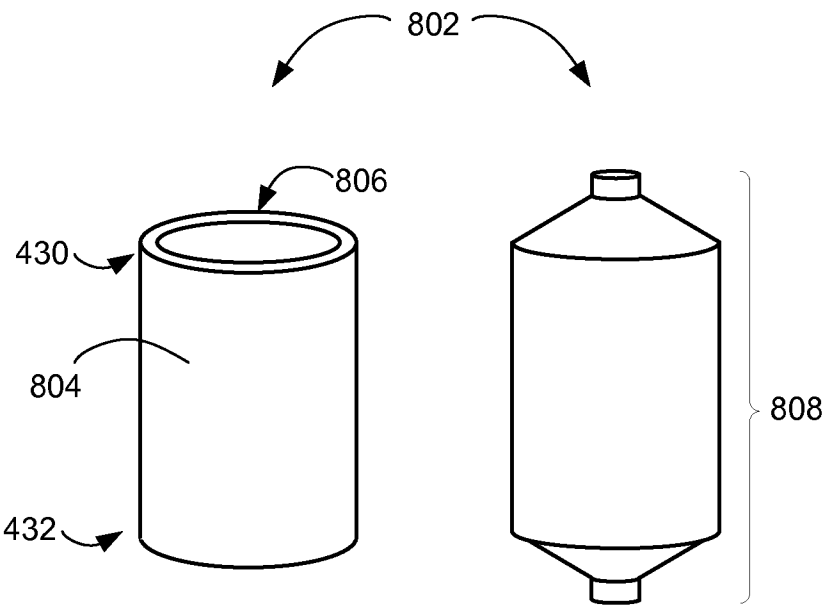
FIG. 8 is an isometric view of a lens unit of the electrical system in a phase of manufacturing.

Referring now to FIG. 8, therein is shown an isometric view of a lens unit 710 of the electrical system 100 in a phase of manufacturing. The lens unit 710 can include the lens wall 110 of FIG. 1, the inner filler 122 of FIG. 1, or a combination thereof. The lens unit 710 can be formed based on forming the lens wall 110, the inner filler 122, or a combination thereof. The lens unit 710 can be formed in a variety of ways.

For example, the lens unit 710 can be formed based on molding the lens wall 110, the inner filler 122, or a combination thereof. As a more specific example, the lens wall 110 including phosphor-silicone mixture and the inner filler 122 including pure or clear silicone can be co-extruded to form the lens unit 710. Also as a more specific example, the lens wall 110, the inner filler 122, or a combination thereof can be formed based on hardening, molding, shaping, or a combination thereof or a combination thereof for various material including silicone, phosphor, other materials, or a combination thereof.

Also as a more specific example, the lens wall 110 corresponding to an outer perimeter surface of the lens unit 710 can be formed using a phosphor-silicone balloon 804. The phosphor-silicone balloon 804 can be formed by blow molding the phosphor-silicone mixture. The phosphor-silicone balloon 804 can further be formed with a phosphor coating 808 by dipping a hollow silicone tubing in phosphor or the phosphor-silicone mixture. The phosphor-silicone balloon 804 can further be formed with the phosphor coating 808 by spraying or coating, utilizing vapor deposition, painting, dipping, or other surface application techniques for applying the phosphor or the phosphor-silicone mixture to the hollow silicone tubing, the inner filler 122, the lens wall 110, or a combination thereof.

Continuing with the more specific example, the lens unit 710 can be formed based on filling the phosphor-silicone balloon 804, the lens wall 110, or a combination with a soft filler 806 including silicone, phosphor, other similar material, or a combination thereof. The soft filler 806 can include the inner filler 122. The soft filler 806 can further become the inner filler 122 based on hardening the soft filler 806.

It has been discovered that the soft filler 806 and the phosphor-silicone balloon 804 provides increased reliability under stress and strain. It has further been discovered that the soft filler 806 and the phosphor-silicone balloon 804 with tapered ends provide increased robustness. The tapered ends can attach to the base structure, reflector, or a combination thereof for a tight or a snug fit. The soft filler 806 and the phosphor-silicone balloon 804 can further minimize light losses at the transition between the base reflectors and the lens, and further simply the attachment process between the lens unit 710 and the substrates.

The lens unit 710 can be formed according to the horizontal dimension 114 of FIG. 1, the vertical dimension 118 of FIG. 1, the elliptical cross-section 202 of FIG. 2, the polygonal cross-section 302 of FIG. 3, the shape measure 404 of FIG. 4, the concave cross-section 402 of FIG. 4, the angled-linear cross-section 403 of FIG. 4, or a combination thereof corresponding to the specific configurations for generating the target intensity profile. The lens unit 710 can further include the first end portion 430 of FIG. 4 one end of the vertical dimension 118 and the second end portion 432 of FIG. 4 on opposite end of the vertical dimension 118.

The lens unit 710 can further include the horizontal mid-region 116 of FIG. 1 in a middle portion of the lens unit 710 along the horizontal dimension 114. The lens unit 710 can also include the vertical mid-region 120 of FIG. 1 in a middle portion of the lens unit 710 along the vertical dimension 118.

The lens unit 710 can further be formed including the suspended reflector 514 of FIG. 5, the suspended reflector 614 of FIG. 6, or a combination thereof. The lens unit 710 can include the suspended reflector located within the inner filler 122 and surrounded by the lens wall 110. The lens unit 710 can further include the suspended reflector located between the first end portion 430 and the second end portion 432. The lens unit 710 can include the suspended reflector with the corresponding reflective surface and the shape measure, located at a relative location, or a combination there of according to the specific configuration for generating the target intensity profile. The lens unit 710 can include the suspended reflector for reflecting light from one or more of the light sources 108 of FIG. 1.

The lens unit 710 can enclose or encapsulate one or more of the suspended reflectors. For example, the lens unit 710 can include the central reflector 624 of FIG. 6, the offset reflector 626 of FIG. 6, or a combination thereof.

The lens unit 710 can be formed based on locating the central reflector 624 at a central location vertically aligned with the vertical mid-region 120, horizontally aligned with the horizontal mid-region 116, or a combination thereof prior to forming or hardening the inner filler 122. The lens unit 710 can be formed based on locating the offset reflector 626 at an offset location vertically aligned away from the vertical mid-region 120 and horizontally aligned away from the horizontal mid-region 116 prior to forming or hardening the inner filler 122.

For example, one or more of the suspended reflector can be secured at the location using the reflector stabilizer 516 of FIG. 5. Also for example, the suspended reflector can further be formed at the location using the three-dimensional printing mechanism. Also for example, the suspended reflector can be located within the lens wall 110 or the balloon. The suspended reflector can be encapsulated or embedded by forming the inner filler 122 around and over the suspended reflector as discussed above.

Figure 9:
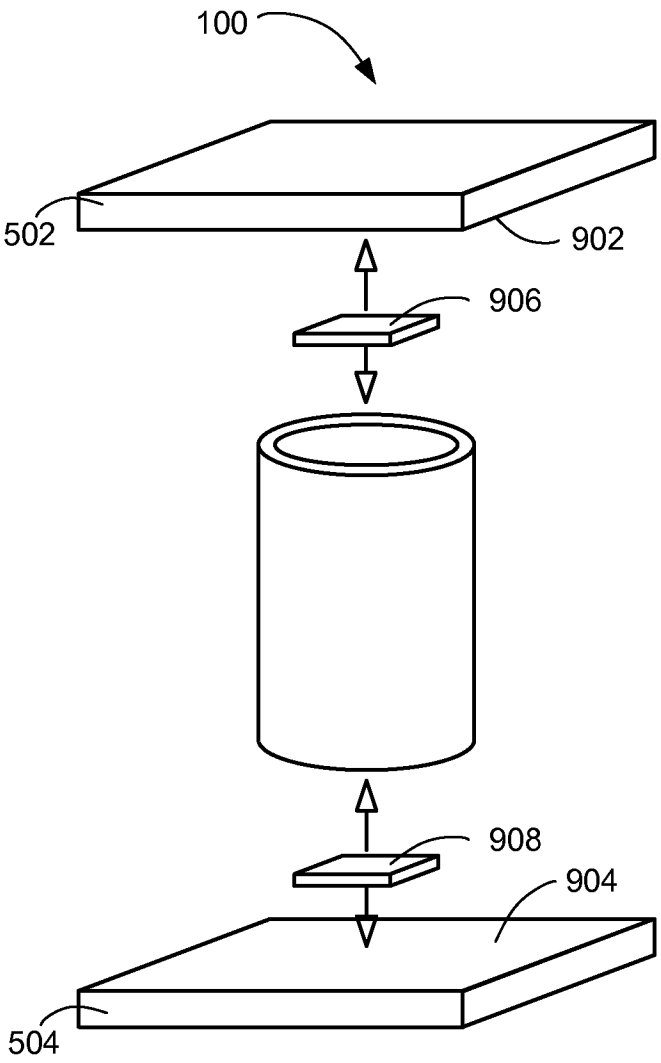
FIG. 9 is an isometric view of the electrical system in a further phase of manufacturing.

Referring now to FIG. 9, therein is shown an isometric view of the electrical system 100 in a further phase of manufacturing. The base structures 106 of FIG. 1 can be provided. The base structures 106 can further include the base cavity 510 of FIG. 5. The base structures 106 can include a substrate, a PCB, or a combination thereof. The base structures 106 can be formed, processed, located, arranged, or a combination thereof for the further phase of manufacturing.

Providing the base structures 106 can include providing the first base structure 502 of FIG. 5, the second base structure 504 of FIG. 5, or a combination thereof. The first base structure 502 and the second base structure 504 can be formed, processed, located, arranged, or a combination thereof for the further phase of manufacturing.

For example, the first base structure 502 can include a first reference surface 902 for the reference surface 512 of FIG. 5. The second base structure 504 can include a second reference surface 904 for the reference surface 512. The first reference surface 902, the second reference surface 904, or a combination thereof can include the base cavity 510.

Continuing with the example, the first base structure 502 and the second base structure 504 can be arranged or located with the first reference surface 902 and the second reference surface 904 facing each other. The first reference surface 902 and the second reference surface 904 can be separated by a distance corresponding to the vertical dimension 118 of FIG. 1 or more. The first reference surface 902 and the second reference surface 904 can be planar surfaces parallel to each other. The first reference surface 902 and the second reference surface 904 can be aligned to vertically match one or more horizontal peripheral edges for the further phase of manufacturing.

The further phase of manufacturing can include providing the light sources 108 of FIG. 1. The light sources 108, such as the first lighting set 703 of FIG. 7 including a light-emitting diode 906, the second lighting set 704 of FIG. 7 including a second diode 908, or a combination thereof, can be provided for attachment to the lens unit 710 of FIG. 7, the base structures 106, or a combination thereof.

The further phase of manufacturing can include attaching one or more of the lens unit 710, the lens wall 110 of FIG. 1, the inner filler 122 of FIG. 1, the light sources 108, or a combination thereof to the base structures 106. The lens unit 710 can be attached over the base cavity 510. The lens unit 710 can include the base cavity 510 with the lens wall 110 surrounding the base cavity 510 along the horizontal plane or direction. The lens wall 110 can also be attached to or within the base cavity 510. The structures can be attached in a variety of ways for the further phase of manufacturing.

For example, the structures can be attached using adhesives between the structures. Also for example, the structures can be attached based on a bond or an attachment through the inner filler 122 to the lens wall 110, the base structures 106, the light sources 108, or a combination thereof. Also for example, the structures can be attached using mechanical fastener, structural fastener, or a combination thereof.

Also for example, the structures can be attached using shapes, surfaces, fits, friction between the structures, or a combination thereof. As a more specific example, the first end portion 430 of FIG. 4 of the lens unit 710 can be attached to the first base structure 502 on the first reference surface 902, the second end portion 432 of FIG. 4 can be attached to the second base structure 504 on the second reference surface 904, or a combination thereof.

Also as a more specific example, the light-emitting diode 906 can be attached to the first base structure 502 on the first reference surface 902, the second diode 908 can be attached to the second base structure 504 on the second reference surface 904, or a combination thereof. The light-emitting diode 906 can be attached to the first end portion 430 of the lens unit 710, the second diode 908 can be attached to the second end portion of the lens unit 710, or a combination thereof. The light-emitting diode 906, the second diode 908, or a combination thereof can be attached within the base cavity 510.

The further phase of manufacturing can include application of phosphor on the light-emitting diode 906, the second diode 908, or a combination thereof. Phosphor can be applied in ways similar to the lens wall 110 as described above, such as spraying or coating, utilizing vapor deposition, painting, dipping, or other surface application techniques. Phosphor can be applied before or after attaching the light sources 108 to the base structures 106. Phosphor can be applied before or simultaneously as attaching the light sources 108 to the lens unit 710 or the inner filler 122 therein.

The further phase of manufacturing can include assembly of the lens unit 710 including the suspended reflector 514 or 614 enclosed therein with the base structures 106, the light sources 108, or a combination thereof. The light sources 108 can be attached according to the specific configuration relative to the lens unit 710 for generating target intensity profile. The suspended reflector 514 or 614 can be located between the light-emitting diode 906 and the second diode 908 for reflecting light from the light-emitting diode 906, the second diode 908, or a combination thereof.

The further phase of manufacturing can further include attachment of one or more instances of the substrate reflector 508 or 608 to the base structures 106, the lens unit 710, or a combination thereof. The substrate reflector 508 or 608 can be attached according to the specific configuration for generating the target intensity profile.

The substrate reflector 508 or 608 can be attached for reflecting light from one or more light sources 108 including the light-emitting diode 906, the second diode 908, or a combination thereof. The substrate reflector 508 or 608 can further be enclosed within the inner filler 122 of the lens unit 710, attached horizontally within the lens wall 110, or a combination thereof.

The substrate reflector 508 or 608, the light sources 108, or a combination thereof can further be attached or embedded within the inner filler 122 in the phase of manufacturing as illustrated in FIG. 8. The substrate reflector 508 or 608, the light sources 108, or a combination thereof can be attached or embedded similar to the suspended reflector suspended reflector 514 or 614 as described above. The substrate reflector 508 or 608, the light sources 108, or a combination thereof embedded within the lens unit 710 can be attached to the base structures 106 during the further phase of manufacturing.

The further phase of manufacturing can include assembly of one instance of the lens unit 710, a pair of LEDs, a pair of substrates, or a combination thereof for each instance of the electrical system 100, the electrical system 300 of FIG. 3, the electrical system 400 of FIG. 4, the electrical system 500 of FIG. 5, the electrical system 600 of FIG. 6, or a combination thereof. The further phase of manufacturing can also include assembly of multiple instances of the lens unit 710 for the pair of substrates.

The multiple instances of the lens unit 710 corresponding to multiple instances of the lighting units 702 of FIG. 7 with corresponding multiple pairings of the first lighting set 703 and the second lighting set 704 can be attached to the pair of substrates corresponding to the set of base structures 706 of FIG. 7. The lighting units 702 can be attached to the pairings of the first lighting set 703 and the second lighting set 704, attached to the set of base structures 706, or a combination thereof for manufacturing the electrical system 700 of FIG. 7.

The second lighting set 704 of FIG. 7 can be attached to both the first base structure 502 and the second base structure 504 at a location according to the lighting arrangement 712 of FIG. 7 along with and relative to the first lighting set 703 of FIG. 7. The second lighting set 704 can including a further instance of the lens unit 710 enclosing the source set 708 of FIG. 7 separate from the light-emitting diode 906 and the second diode 908.

The further phase of manufacturing can include manufacturing the electrical system 700. The further phase of manufacturing can include separating the multiple instances of the lighting units 702 based on cutting or separating the first base structure 502 and the second base structure 504 along the vertical direction or plane between the lighting units 702. The remaining instances of the lighting units 702 can be the electrical system 700, the electrical system 100, the electrical system 300, the electrical system 400, the electrical system 500, the electrical system 600, or a combination thereof.

Figure 10:
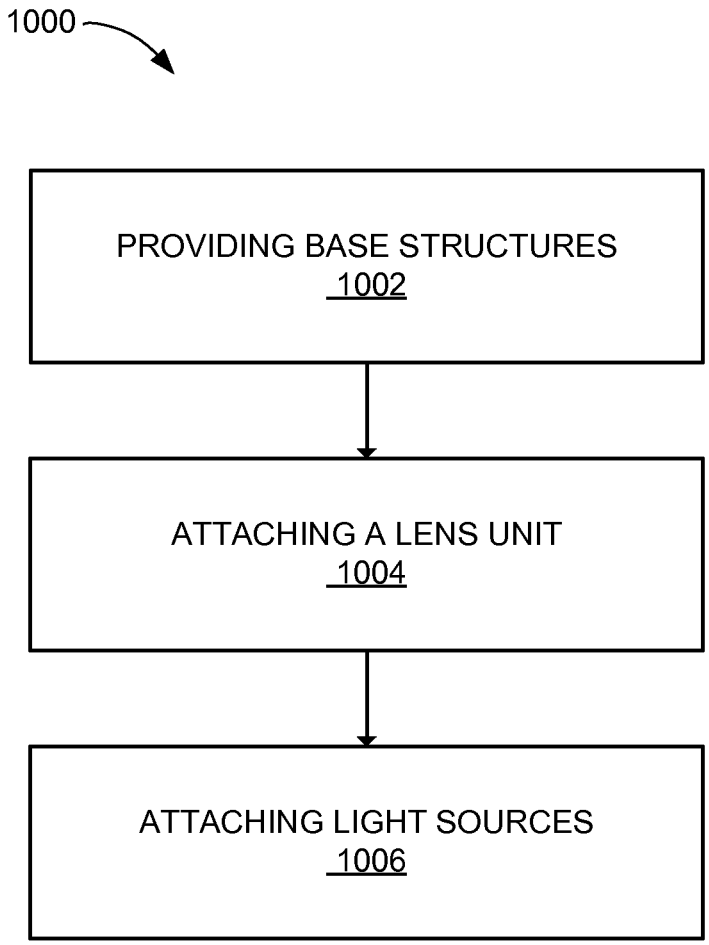
FIG. 10 is a flow chart of a method of manufacture of an electrical system in an embodiment of the present invention.

Referring now to FIG. 10, therein is shown a flow chart of a method 1000 of manufacture of an electrical system in an embodiment of the present invention. The method 1000 includes: providing base structures in a box 1002; attaching a lens unit to the base structures on a first end portion and a second end portion of the lens unit in a box 1004; and attaching light sources to the base structures in a box 1006.

The resulting method, process, apparatus, device, product, and/or system is straightforward, cost-effective, uncomplicated, highly versatile, accurate, sensitive, and effective, and can be implemented by adapting known components for ready, efficient, and economical manufacturing, application, and utilization. Another important aspect of an embodiment of the present invention is that it valuably supports and services the historical trend of reducing costs, simplifying systems, and increasing performance.

These and other valuable aspects of an embodiment of the present invention consequently further the state of the technology to at least the next level.

While the invention has been described in conjunction with a specific best mode, it is to be understood that many alternatives, modifications, and variations will be apparent to those skilled in the art in light of the aforegoing description. Accordingly, it is intended to embrace all such alternatives, modifications, and variations that fall within the scope of the included claims. All matters set forth herein or shown in the accompanying drawings are to be interpreted in an illustrative and non-limiting sense.

What is claimed is:

1. An electrical system comprising:

a first base structure;

a second base structure spaced apart from and opposing the first base structure;

a first light source attached to the first base structure;

a second light source attached to the second base structure;

a lens unit having a lens wall comprising a horizontal dimension and a vertical dimension for enclosing the first and second light sources, the lens wall including a first end portion attached to the first base structure and a second end portion attached to the second base structure, wherein the aspect ratio between the horizontal dimension and the vertical dimension of the lens unit is configurable for (i) providing a controlled uniform light intensity along the lateral direction of the vertical dimension of the lens unit and (ii) creating an additive effect on the light intensity from the first light source and the second light source, wherein the aspect ratio is any ratio providing the uniform light intensity; and a substrate reflector attached to the first base structure and enclosed in the lens unit at the first end portion, the substrate reflector for reflecting light from the first light source, the second light source, or a combination thereof to generate a target light intensity profile of the lens unit.

2. The system as claimed in claim 1 further comprising a shape measure for representing the lens unit being narrower around a vertical mid-region than at the first end portion, the second end portion, or a combination thereof to generate a target light intensity profile of the lens unit.

3. The system as claimed in claim 1 further comprising a suspended reflector enclosed in the lens unit and located between the first light source and the second light source for reflecting light from the first light source, the second light source, or a combination thereof to generate a target light intensity profile of the lens unit.

4. The system as claimed in claim 1 further comprising a further lighting set attached to both the first base structure and the second base structure, the further lighting set including a further lens enclosing a light source set separate from the first light source and the second light source.

5. The system as claimed in claim 1 wherein:

the second base structure is spaced apart from the first base structure by the vertical dimension corresponding to the lens unit;

the first light source includes a light-emitting diode; and the second light source includes a second diode located opposite to the first light source across a horizontal plane.

6. The system as claimed in claim 5 wherein the lens unit corresponds to a shape measure for representing the lens unit with a concave cross-section or an angled-linear cross-section.

7. The system as claimed in claim 5 further comprising a suspended reflector enclosed in the lens unit and located between the first light source and the second light source, the suspended reflector including a linear reflective surface, a curved reflective surface, or a combination thereof for reflecting light from the first light source, the second light source, or a combination thereof.

8. The system as claimed in claim 5 wherein the substrate reflector includes a linear reflective surface, a curved reflective surface, or a combination thereof for reflecting light from the first light source, the second light source, or a combination thereof.

9. The system as claimed in claim 5 further comprising a further lighting set attached to both the first base structure and the second base structure at a location according to a lighting arrangement, the further lighting set including a further lens enclosing a light source set separate from the first light source and the second light source.

10. An electrical system comprising:

a first base structure with a first reference surface;

a second base structure spaced apart from the first base structure, the second base structure including a second reference surface facing the first reference surface;

a lens unit including a first end portion attached to the first base structure and a second end portion attached to the second base structure, the lens unit further including phosphor, silicone, or a combination thereof;

a first light-emitting diode attached to the first reference surface of the first base structure and enclosed within the lens unit;

a second light-emitting diode attached to the second reference surface of the second base structure and enclosed within the lens unit, wherein lens unit has a lens wall comprising a horizontal dimension and a vertical dimension, enclosing the first and second light-emitting diodes, and wherein an aspect ratio between the horizontal dimension and the vertical dimension of the lens unit is configurable to (i) provide a controlled uniform light intensity along the lateral direction of the vertical dimension of the lens unit and (ii) create an additive effect on the light intensity from the first light light-emitting diode and the second light-emitting diode, wherein the aspect ratio is any ratio providing the uniform light intensity; and a substrate reflector attached to the first base structure and enclosed in the lens unit at the first end portion, the substrate reflector for reflecting light from the first light source, the second light source, or a combination thereof to generate a target light intensity profile of the lens unit.

11. The system as claimed in claim 10 wherein:

the horizontal dimension of the lens unit includes a horizontal mid-region in a middle portion of the horizontal dimension and the vertical dimension of the lens unit includes a vertical mid-region in a middle portion of the vertical dimension; and the system further comprising:

a central reflector enclosed in the lens unit and vertically aligned with the vertical mid-region, horizontally aligned with the horizontal mid-region, or a combination thereof.

12. The system as claimed in claim 10 wherein:

the horizontal dimension of the lens unit includes a horizontal mid-region in a middle portion of the horizontal dimension and the vertical dimension of the lens unit includes a vertical mid-region in a middle portion of the vertical dimension; and the system further comprising:

an offset reflector enclosed in the lens unit and vertically aligned away from the vertical mid-region and horizontally aligned away from the horizontal mid-region.

13. The system as claimed in claim 10 wherein the lens unit includes a phosphor coating on the first light-emitting diode, the second light-emitting diode, or a combination thereof.

14. The system as claimed in claim 10 wherein the lens wall of the lens unit includes a phosphor coating formed on an outer perimeter surface of the lens unit.

15. A method of manufacture of a communication system comprising:

providing a first base structure;

providing a second base structure;

spacing the second base structure apart and opposing the first base structure;

attaching a first light source to the first base structure;

attaching a second light source to the second base structure;

attaching a lens unit having a lens wall comprising a horizontal dimension and a vertical dimension enclosing the first and second light sources, the lens wall including a first end portion attached to the first base structure and a second end portion attached to the second base structure;

configuring the aspect ratio between the horizontal dimension and the vertical dimension of the lens unit to (i) provide a controlled uniform light intensity along the lateral direction of the vertical dimension of the lens unit and (ii) create an additive effect on the light intensity from the first light source and the second light source, wherein the aspect ratio is any ratio providing the uniform light intensity; and forming a substrate reflector on one or more of the base structures for reflecting light from the first or second light sources, or a combination thereof.

16. The method as claimed in claim 15 further comprising forming the lens wall using a phosphor-silicone balloon and forming the lens unit based on filling the lens wall with a soft filler.

17. The method as claimed in claim 15 further comprising coating the lens wall with a phosphor coating and forming the lens unit based on filling the lens wall with a soft filler including silicone.

18. The method as claimed in claim 15 further comprising suspending a reflector between the light sources for reflecting light from the first or second light sources, or a combination thereof.

* * * * *